United States Patent [19]

Otsu et al.

[11] 4,075,064

[45] Feb. 21, 1978

[54] PROCESS FOR THE MARKING ON METAL OR THE LIKE SURFACES

[76] Inventors: Iwao Otsu; Motohisa Watanabe, both of c/o Kawaguchiko Seimitsu Company Limited, 6663-2, Funatsu, Kawaguchiko, Minamitsuru, Yamanashi, Japan, 401-03

[21] Appl. No.: 728,057

[22] Filed: Sept. 30, 1976

[30] Foreign Application Priority Data

Oct. 1, 1975 Japan ..... 50-118657

[51] Int. Cl.[2] ..... C25D 5/02; C25D 5/34

[52] U.S. Cl. ..... 204/18 R; 204/38 R

[58] Field of Search ..... 204/18 R, 15, 32 R, 204/38 R, 38 C, 38 E

[56] References Cited

U.S. PATENT DOCUMENTS

| | | | |
|---|---|---|---|
| 1,373,430 | 4/1921 | Humphrey | 204/18 R |
| 2,354,756 | 8/1944 | Keuffel et al. | 204/18 R |
| 2,426,962 | 9/1947 | Witchger | 204/18 R |
| 2,795,032 | 6/1957 | Kerstetter | 204/18 R |

*Primary Examiner*—T. M. Tufariello

*Attorney, Agent, or Firm*—Fleit & Jacobson

[57] ABSTRACT

According to this invention, a broad stock sheet is prepared and subjected preparatorily to degreasing and cleaning treatments. Then, a series of desired patterns are provided on the stock sheet by the transfer printing or screen printing technique with a color ink paste containing dyestuff or pigment color and resin binder and then the printed patterns are heat set. The stock is chemically or electro-chemically plated with a metal layer, with exception of the printed and baked patterns. Punching is made for separating final products from the stock sheet, either before execution of the said printing step or after the said final plating step.

6 Claims, 7 Drawing Figures

PROCESS FOR THE MARKING ON METAL OR THE LIKE SURFACES

BACKGROUND OF THE INVENTION

This invention relates to improvements in and relating to the process for providing markings on metal surfaces Conventional marking processes may include those of printing, punching or etching the desired markings comprising characters, symbols and/or designs on metal surfaces.

The printing process, however, represents such a substantial drawback that the printed markings are liable to be scaled off from the base metal surface, thus providing no permanently durable markings. On the other hand, when employing the punching or stamping process, the thus produced markings represent superior permanency. However, they represent no sharply marked edges which are naturally a substantial drawback, especially when marking fine designs. This drawback will become more apparent with use of harder base metal such as stainless steel.

In the case of the etching process, even if included the photo-etching one, a mass productive efficiency could be realized only with substantial difficulty.

Other highly well known similar technique such as the engraving process, including the electrolytic engraving one, represents several drawbacks, as will appear on a comparative list which is attached hereto at the end of this specification.

It is, therefore, the main object of the present invention to provide an improved marking process by which a sharply defined and highly durable marking, either of recesses or reliefs as desired, can be provided on a metal or similar base material surface in a mass productive highly efficient mode.

The process according to this invention comprises three successive basic processing steps as follows.

I. Surface Conditioning Step

As an example, the final products are assumed to be a number of counter weight sector plates which are used in automatic winding mechanical watches.

At first, a brass band web, 0.4–0.8 mm thick, is prepared and a number of sector stocks are punched out therefrom on a high speed punching press.

The punched sector stocks are then cleaned with a proper solvent, preferably trichloroethylene, for degreasing.

Additional treatments with alkali, such as a dilute sodium hydroxide aqueous solution, and then with a dilute acid solution for pickling may be carried out, if desired, for completion of the desired degreasing effect.

Next, a rotatable barrel is prepared and a proper quantity, 10 liters as an example, of clean fresh water is charged therein, together with a proper amount, 1 kg as an example, of clean sand or fine gravel. 10,000 to 100,000 pieces of the above sector stocks are charged in the barrel which is then driven to rotate at a slow speed, such as 10 r.p.m., for removal of excess fillets from the punched-out stocks. The thus treated stocks are taken out from within the barrel and dried up in a hot air stream. The surface conditioning step has thus been completed.

II. Patterning Step

Next, a printing or resist-providing step is carried out for providing required markings on the stock by the use of printing ink, preferably of the thermosetting character. As the ink, it may include dyestuff(s) or pigment, as the case may be. However, in practice, the latter mode is better.

The printing may preferably be carried out by the use of a stencil, carrying engravings formed thereon, so as to represent the desired markings. In printing, the ink is naturally given exclusively in the engravings.

The practical printing step is carried out by means of a pad to transfer the patterned ink from the stencil onto the stock. The thickness of the inked pattern may preferably be of such thickness as of in the order of 1–10 microns.

The printing step is followed by a baking step, say, at 200°–220° C for baking the transferred ink pattern on the stock.

The patterning or pattern-fing step has been thus completed.

III. Metal-Coating Step

The thus prepared and processed stocks are subjected to a metal-coating step including preparatory auxiliary treatments.

The stocks are subjected to preparatory successive cleaning treatments by means of degreasing, alkali and acid as before, and then to a metal coating step, in the electroplating or purely chemical mode, using the inked and baked pattern on each of the stock, as resisting agent, so as to cover the remaining base, preferably metal surfaces with a metal coating. The thus processed stocks are further subjected to several after-treatments, such as cold water-cleaning, hot water-cleaning and drying treatments.

The coating may comprise exclusively nickel, or successive layers of copper and gold, as an example.

The foregoing transfer printing step may be replaced by a corresponding screen-printing one.

Generally speaking, the process according to this invention may provide a recessed pattern, where the printed ink pattern is selected to have a smaller thickness than the coated metal layer. However, if desired, a relief pattern can be provided by selecting the reversed thickness relationship between the printed and the coated layers.

These and further objects, features and advantages of the invention will become more apparent when read the following detailed description substantially given by way of examples together with several illustrating sketches.

DETAILED DESCRIPTION OF THE INVENTION

Figure 1:
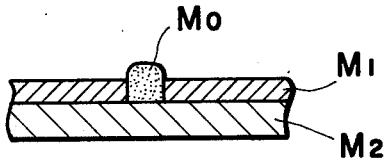
FIGS. 1–3 illustrate main different features of the pattern-formation step which is the main step of the inventive process.

In FIG. 1, a preferred relief mode pattern-making step is shown according to this invention. In this figure, $M_0$ represents schematically an inked pattern which has a larger thickness than the metal-coated layer $M_1$. Naturally and generally, these layers $M_0$ and $M_1$ may be preferably mutually different color tones which must further be a different color from that of the material of the stock which is shown at $M_2$.

As ascertained from the above disclosure, a broad selectability of color and its tone can be assured in carrying out the process according to this invention.

The ink material naturally must have a resisting performance to the coating solution, in addition to enough depositing performance onto the stock material. In this respect, therefore, a broad selectability is assured.

In practice, the process can be so modified that the above ink-marked area can be replaced by the metal-coated area, and vice versa.

Figure 2A:
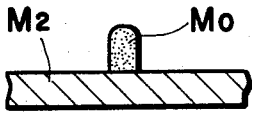
Figure 2B:
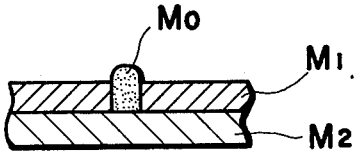
Figure 2C:
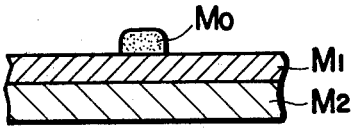
FIG. 2(C) PRIOR ART

In FIG. 2, a comparison is made between the inventive process modes at (A) and (B), and the conventional process at (C), where the meanings of $M_0$, $M_1$ and $M_2$ are same as before.

Figure 3A:
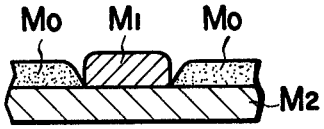
Figure 3B:
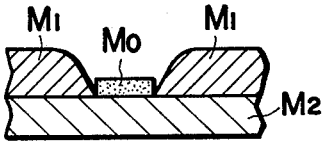
Figure 3C:
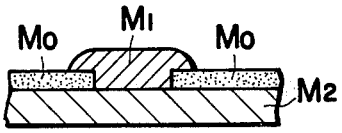

FIG. 3 illustrates three different modes of the product of the process according to this invention.

At (A), FIG. 3, the pattern area $M_1$ which is constituted by a metal coating represents a slightly larger thickness than the ink-baked area $M_0$, so as to represent a slightly relieved pattern. This thickness relationship may naturally be reversed.

In these cases, an appreciable side shrink effect can be realized for giving a sharply defined pattern effect.

At (B), FIG. 3, the pattern of printed and baked ink layer $M_0$ has a substantially smaller thickness than the metal-coated layer $M_1$, so as to provide a highly recessed pattern effect. In this case, also, an appreciable side shrink effect is provided so as to provide a sharply defined pattern effect.

If desired, the material kind may be replaced for each other at $M_0$ and $M_1$.

At (C), FIG. 3, an appreciably elevated patter of coated metal $M_1$ is shown, in comparison with ink-coated and baked area $M_0$. In this case, an appreciably side-spreading effect at the pattern area is visible.

EXAMPLE 1

A number of sector-shape counter weight stocks adapted for use with mechanical watches and perforated at the sector center, are successively and automatically punched out from a brass band sheet, 0.4–0.8 mm thick, on a punching press. Then, these punched stocks, 10,000 pieces, are dipped in a petroleum benzine bath for a short time under shaking for degreasing.

These degreased sector stocks are charged in a fresh water pool contained in a rotatable barrel, together with small gravels. The barrel is rotated at 50–80 r.p.m. for 10 minutes for the removal of excess filets, taken out from the barrel and dipped in a fresh water bath for 20 minutes for cleaning purpose. Then, the stocks are dried up in hot air stream, 70° C.

As a preparatory job to the next printing step, a stencil is prepared which consists of a steel plate (10 mm thick, 50 mm × 50 mm square — SK or SKH steel prescribed in Japanese Industrial Standards, or briefly "JIS"). Desired markings such as "CITIZEN WATCH COMPANY LIMITED" and the like are engraved electrochemically on the stencil by conventional photo-etching process.

A proper offset printing black ink, including carbon black as coloring agent and alkyd phenol resin as binder, such as "TSP 202", manufactured and sold by Toyo Ink Manufacturing Company, Tokyo, is coated on the engraved surface of the stencil, and excess amount of the ink is wiped out from the stencil surface, with the engravings, having a depth of 10–100 microns, filled with the ink.

Next, an ink-transferring pad, made preferably of urethane rubber, is prepared and brought into light pressure contact with the engraved surface of the stencil, for transferring partially the reserved ink from the engraved pattern. Then, the inked pad is brought into light pressure contact with the stock for marking thereon, and so on.

The thus pattern-inked stocks are placed on a travelling conveyor passing through an oven for baking the inked patterns successively at about 200°–220° C for about 10–20 minutes.

Then, these pattern-baked stocks are suspended on a horizontally tensioned wire hanger at a mutual distance of about 3–5 cm, passing the wire through sector center holes of the stocks. These suspended stocks, together with the wire hanger, is dipped for 30 seconds-1 minute in a vessel, containing a degreasing aqueous bath comprising 5 wt.% of sodium orthosilicate and 0.3 wt.% of "Scorerol" (rauryl ether base nonionic sufactant), manufactured and sold by Kao-Atlas Company, Tokyo), at 50°–60° C.

The degreased stocks are dipped in an aqueous 5 wt.%-aqueous NaOH bath for 10–20 seconds and passed several times through fresh water cleaning baths for enough cleaning.

Next, the stocks are subjected to a neutralizing treatment, by dipping them at normal temperature for 10–20 seconds in an aqueous acid bath, containing a small amount of 5 wt.% diluted sulphuric acid, and then washed with fresh water, thereby completing the preparatory treatment step.

Next, the thus preparatorily treated stocks are subjected to a glazing nickel plating step by galvanizing them in an aqueous Watts bath (composition : nickel sulphate -240 g/lit; nickel chloride -45 g/lit; borric acid -30 g/lit; glazing agent (saccharin) -5 g/lit; and remainder being fresh water) at 45°–60° C, 2–5 amp.dm$^3$, for 10–30 minutes. In this way, all the surface area of the stock with exception of ink-baked patterns is well nickel-plated with bright. The thickness of the nickel coating amounted to 5–15 microns.

After execution of the galvanizing step mentioned above, the products are subjected to several cold water washing steps and to a final warm water treatment.

Upon reviewed, the final product represents a combination of a beautiful and durable recessed black marking surrounded by a bright nickel background.

The marking is highly durable and can not be scaled off from position, even if anti-scale-off test as described in JIS has been carried out by use of a sticking tape.

If desired, a golden tone pattern can be provided by applying additionally a gold-plating step.

Other color tone than black can be given by displacing the black printing ink by a correspondingly different pigment color ink. In this way, the pattern may represent any desired different color. Mixed color effect can also be provided by applying the multi-color printing technique.

EXAMPLE 2

In the foregoing Example 1, the carbon-containing printing ink has been replaced by a red-colorful one, containing a proper amount of nacridon base red dyestuff, and other procedures are followed as disclosed therein. In this way, modified products representing red colored patter design can be provided.

Other printing ink, containing threne dyestuff "Indanthrene Scarlet B" may be used for the same purpose.

Green color pattern can also be produced by the use of a printing ink paste containing phthalocyanine green or dibenzanthrene dyestuff. Or alternatively, blue color pattern can be produced by the use of a printing ink paste containing phthalocyanine blue or indanthrene blue BS dyestuff.

Purple color pattern can also be produced by the use of a printing ink paste containing dioxazine dyestuff, PV fast violet BL or threne dyestuff, consisting of halogenated isobioranthrene.

Various other color patterns may be brought about by the use of other proper dyestuffs of pigment colors included in the respective printing ink pastes.

EXAMPLE 3

Screen printing process has been replaced for the transfer printing technique hereinbefore described, so as to increase the thickness of the printed pattern till 10 microns or more.

In this way, relief patterns are produced in place of the recessed or engraved style patterns.

EXAMPLE 4

In Example 1, the punching step is shifted from the first to final stage of the process, as after the execution of the galvanizing or chemical coating step.

In this way, the process could be made continuous and the process efficiency has been highly improved.

EXAMPLE 5

In place of the galvanizing or electroplating step of the process described in Example 1, chemical coating process has been employed with substantially equal results.

| The plating bath may be as such: | |
|---|---|
| nickel sulphate | 35 g/lit; |
| sodium hypophofite | 10 g/lit; |
| sodium acetate | 7 g/lit; |
| sodium citrate | 10 g/lit; |
| pH | 5.6 - 5.8 |
| bath temperature | 85° C |
| treating time | 5 - 15 minutes; |
| thickness of metal coating | 3 - 7 microns. |

Plastic materials may be used in place of metal base, when they are modified or sensitized as conventionally so as to be ready for being subjected to a chemical metal coating process. As the metal layer forming process to be adopted in this modified embodiment of the invention, chemical coating process is recommended.

The embodiments of the invention in which an exclusive property or privilege is claimed are as follows:

1. Process for the marking of small metallic pieces comprising the steps of:

preparing a smooth metal stock sheet comprising the steps of punching out a smooth metal sheet to form small metallic piece stocks, degreasing said stocks with an organic solvent, placing the degreased stock in a barrel containing fresh water and gravel, rotating the barrel at a slow speed for removing excess fillets from the stocks, removing the stocks from the barrel, and then drying the stocks in a hot air stream;

printing characters or a like fine pattern of 1-10 microns thickness on the stock by an ink transferring step or screen printing step by providing a color printing ink paste having a resisting or impulsing characteristic to a plating bath liquid to be used;

baking the printed pattern; and plating chemically or electrochemically an anticorrosive metal layer on the surface of said stock, with the exception of the area of said printed pattern so that the printed pattern has a substantially smaller height from the stock than the plated metal layer and presents a sharp contrast to the plated metal layer, said printed pattern being protected by the metal layer from wear caused by contact.

2. The process of claim 1, wherein a punching step is executed after the plating step for removal of a number of final products from said stock sheet.

3. The process of claim 1 wherein following the baking step, the stock is subjected to a further degreasing and cleaning step.

4. The process of claim 6 wherein following the plating step, the stock is subjected to cold water washing.

5. The process of claim 1 wherein said degreasing step comprises degreasing said stocks with trichloroethylene, said steps of rotating the barrel comprises rotating the barrel at 10 RPM.

6. The process of claim 5 wherein said placing step comprises placing 10,000 to 100,000 pieces of stock into the barrel.

* * * * *